US005163828A

United States Patent [19]

Coddington, Jr.

[11] Patent Number: 5,163,828

[45] Date of Patent: Nov. 17, 1992

[54] SURFER SWING

[75] Inventor: Russell J. Coddington, Jr., Everett, Pa.

[73] Assignee: Hedstrom Corporation, Beford, Pa.

[21] Appl. No.: 637,122

[22] Filed: Jan. 3, 1991

[51] Int. Cl.[5] ..... A63G 9/04

[52] U.S. Cl. ..... 472/118; 297/273

[58] Field of Search ..... 272/85-92; 297/245, 273-282

[56] References Cited

U.S. PATENT DOCUMENTS 1,642,740 9/1927 Mitchell .
3,447,802 6/1969 Grudoski ..... 297/245 X
4,190,283 2/1980 Boucher ..... 272/85 X

FOREIGN PATENT DOCUMENTS 3139469 4/1983 Fed. Rep. of Germany ..... 272/85

OTHER PUBLICATIONS

Popular Mechanics, p. 79, Aug. 1972, "Stand-up Swing".

*Primary Examiner*—Richard E. Chilcot, Jr.
*Attorney, Agent, or Firm*—Cesari and McKenna

[57] ABSTRACT

A swing comprises an overhead support, an elongated rigid platform having a longitudinal axis, a pair of mirror-image hangers, first and second spaced-apart pivots pivotally connecting the lower ends of the hangers to opposite ends of the platform substantially on the platform axis, and third and fourth spaced-apart pivots pivotally connecting the upper ends of the hangers to the overhead support, the pivot axis of all of the pivots being parallel to each other and perpendicular to the platform axis and the spacing of the third and fourth pivots being less than that of the first and second pivots.

10 Claims, 1 Drawing Sheet

SURFER SWING

FIELD OF THE INVENTION

This invention relates generally to a swing set. It relates more particularly to a swing set to be used to simulate a surfboard ride.

BACKGROUND OF THE INVENTION

A swing of the general type usually comprises a seat suspended from an overhead support by a pair of flexible hangers such as chains or ropes.

This type of swing is generally not suitable for swinging in a standing position for a number of reasons. First of all, the flexible hangers usually serve unsatisfactorily as handles for a rider who stands on the seat. Further, when the hangers are used as handles, the swing tends to operate poorly because the strain imposed on the hangers causes them to flex or bend. Additionally, while swinging, the seat can tilt abruptly thereby making it difficult for a rider in a standing position to maintain his balance. Moreover, the seat is sometimes made of flexible material making it dangerous to stand on during use.

U.S. Pat. No. 1,642,740, to Mitchell discloses a swing in which rigid, rather than flexible, hangers are used. These hangers are pivotally connected to an overhead support and the seating platform is both flat and rigid. Also, ample clearance is provided between the platform and the overhead support to enable a rider to stand on the platform when the swing is in motion if he so desires. The Mitchell swing also differs from the general type described above in that, during swinging, its seating platform ascends and descends while remaining in a plane that remains generally parallel to the ground.

For a swing of the general type, the rider, whether sitting or standing, is positioned between the two hangers facing the direction in which the swing seat moves forward. The Mitchell swing rider is encouraged to sit sideways and look in the direction perpendicular to that in which the seating platform pendulates; when the rider does choose to stand on the platform, the construction of that swing induces him to face in the direction toward which the platform moves, holding to an overhead frame member or on to adjacent hangers as on a conventional swing.

To our knowledge, there is no swing designed especially to simulate a surfboard ride. That is, what is needed is a swing which not only enables one to stand on a pendulating platform sideways comfortably during the ride, but which also changes the angle or tilt of the platform relative to the ground gradually and smoothly in the manner of a surfboard on water.

SUMMARY OF THE INVENTION

Accordingly, the present invention aims to provide a swing to be used to simulate a surfboard ride.

Another object of the invention is to provide a surfer swing which enables a rider to stand sideways safely on the swing platform while swinging.

A further object of the invention is to provide a swing of this type which pendulates satisfactorily when the rider is in a standing position on the swing platform.

Yet another object of the invention is to provide such a surfer swing which is relatively simple and inexpensive to make.

It is still another object of the present invention to provide a swing of that type which has a relatively long use life.

Other objects will, in part, be obvious and will, in part, appear below.

The invention accordingly comprises the features of construction, combination of elements and arrangement of parts which will be exemplified in the following detailed description, and the scope of the invention will be indicated in the claims.

Briefly and generally, the surfer swing comprises a flat, rigid, elongated swing platform which is swingably supported from an overhead support by a pair of rigid hangers which function also as handles.

The upper ends of the hangers are pivotally connected to a bracket mounted to the support which may be, for example, the crossbar of a gym set. The lower ends of the hangers, on the other hand, are pivotally connected to opposite ends of the platform on the longitudinal centerline thereof. All of the pivotal connections of the hangers to the bracket and to the swing platform have their pivot axes extending perpendicular to the hangers and to the platform centerline so that the platform can be swung back and forth in a direction parallel to the platform centerline. However, as we shall see later, these pivotal connections may inhibit sideways swing movements of the swing platform and rotation of the platform about its longitudinal centerline.

The attitude of the swing platform while swinging is determined primarily by the relative difference in the pivot spacings at the upper and lower ends of the hangers. In applicant's swing, the distance between the pivotal connections of the hangers to the supporting bracket is greater than zero, but appreciably less than the distance between the pivotal connections of the hangers to the platform. Resultantly, when the platform swings on its hangers, it has a locus of motion which causes the platform to tilt only a relatively small amount about its transverse centerline as the platform moves away from its neutral or at-rest position.

Furthermore, when the swing is in motion, the rate of change of that platform tilt is much less than that of a conventional swing. Accordingly, a child can stand sideways safely on the platform between the hangers as he or she would stand on a surfboard and, while holding on to the hangers fore and aft, shift weight to elicit a swinging motion of the platform which is much like the surging, planing motion of a surfboard on the water. Preferably, to emphasize this parallel, the swing platform is sized and shaped to have the general shape of a small surfboard. The platform may be made of any suitable material. However, it is most preferably made as a hollow molded plastic article in order to minimize weight and material cost and to facilitate making the platform in quantity at minimum cost.

BRIEF DESCRIPTION OF THE DRAWING

The above and further advantages of the invention may be better understood by referring to the following description in conjunction with the accompanying drawing, in which.

In all the drawings, identical numbers represent identical elements. Further, as used herein, the terms such as "upper", "lower", "top", "bottom" and the like are intended only to denote relative direction solely with reference to the figures in the accompanying drawing.

DETAILED DESCRIPTION OF ILLUSTRATIVE EMBODIMENT

Figure 1:
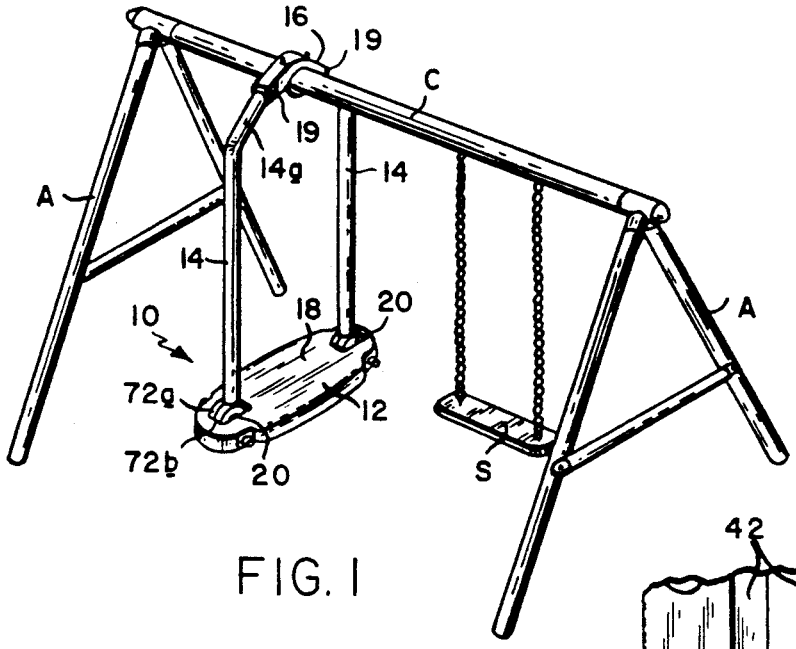
FIG. 1 is an isometric view of a gym set including a surfer swing which embodies the present invention.

Referring now to FIG. 1 of the drawing which shows a play gym comprising a raised crossbar C supported at its ends by a pair of A-frames A. Suspended from crossbar C is a conventional swing S and a surfer swing 10 incorporating this invention.

The illustrated surfer swing 10, which is a preferred embodiment of the invention, includes an elongated platform 12, suspended by a pair of mirror-image hangers 14 from a conventional bracket 16 mounted to crossbar C.

The hangers 14 are a pair of identical (mirror-image when installed), elongated, rigid parts made of metal or other suitable material. The length of the hangers 14 may exceed appreciably the height of a child so that the rider will not strike his or her head against the bracket 16 or the crossbar C when standing on platform 12. Preferably, the hangers 14 are relatively large diameter tubes which can be gripped by the swing rider tightly and comfortably. The upper end segments 14*a* of hangers 14 are bent off axis and the hangers are pivotally connected to bracket 16 by pins or bolts 19, the axes of which extend perpendicular to the direction of bending of hanger segments 14*a* and parallel to crossbar C. In other words, when the hangers 14 are suspended from bracket 16, they are mirror images of one another and can swing in a direction perpendicular to the crossbar.

Platform 12 is much larger than a conventional swing seat; typically it is about 27 inches long and 10 inches wide. Preferably, the platform 12 is hollow to reduce weight and molded or extruded of a suitable plastic material such as high density polyethelyene. It is important that the platform 12 be relatively sturdy and resistant to bending so that it can withstand the body weight of the rider and the rigors of everyday use. It is also important that the platform 12 have a relatively flat top surface 18 on which the rider can stand safely and comfortably. In this preferred embodiment, the platform 12 is more or less ovular so that it looks somewhat like a small surfboard. Formed adjacent to each end of the swing platform 12 is an elongated vertical opening 20 which extends through the hollow platform. Each opening is centered on the longitudinal axis of the platform such that the opening axis extends parallel to the platform axis.

Figure 2:
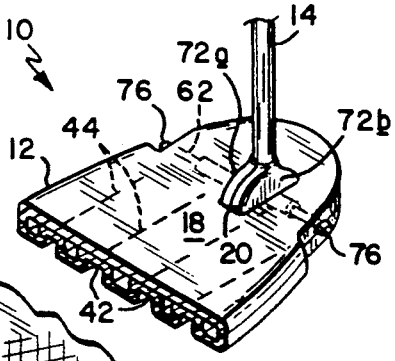
FIG. 2 is a fragmentary isometric view on a larger scale and partially out away of a portion of the surfer swing shown in FIG. 1.
Figure 2:
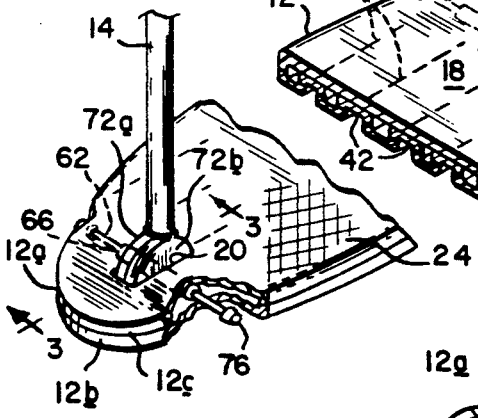
Figure 3:
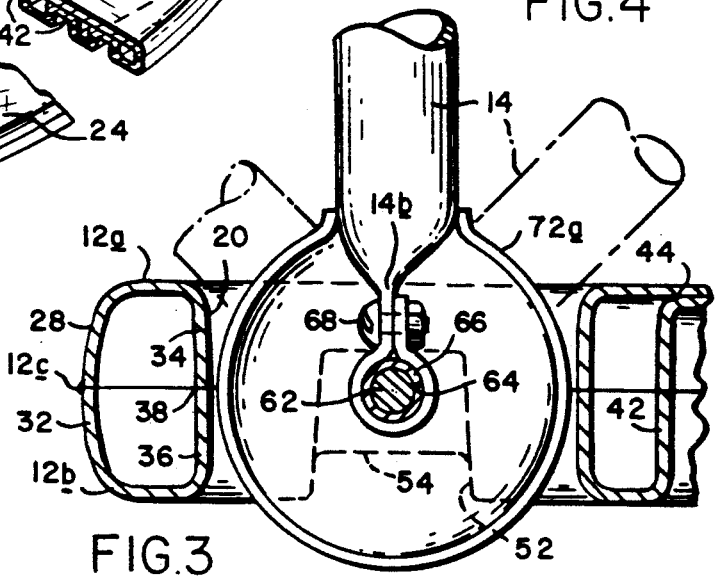
FIG. 3 is a fragmentary sectional view taken along the line 3—3 of FIG. 2.

FIGS. 2 and 3 show the platform 12 in greater detail. The platform comprises upper and lower shells 12*a* and 12*b* connected together at their edges at a seam 12*c*. Shell 12*a* is more or less flat and its top surface, i.e. swing surface 18, is embossed with a tread design 24. Shell 12*a* has a peripheral flange 28 which extends down to a corresponding upwardly extending flange 32 of shell 12*b*, the two shell flanges meeting along seam 12*c*.

Each platform opening 20 is defined by a downwardly extending flange 34 in upper shell 12*a* and a corresponding upwardly extending flange 36 in lower shell 12*b*, these being joined at a seam 38. The bottom shell 12*b* is formed with a set of upwardly extending ridges 42 which extend longitudinally between flanges 36, the tops of the ridges being "welded" along seams 44 to the underside of shell 12*a*. These ridges, along with flanges 28, 32, 34 and 36, make platform 12 quite rigid and resistant to racking and bending.

Figure 4:
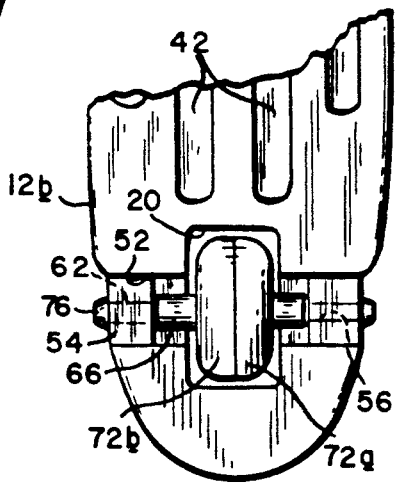
FIG. 4 is a fragmentary bottom view of the swing.

Referring now to FIGS. 3 and 4, platform 12 has a pair of transverse grooves or channels 52 in its underside, i.e. in shell 12*b*, which bisect openings 20. Also a pair of longitudinal recessed ribs 54 are formed in the platform shell 12*b* adjacent to the opposite ends of each such groove. Holes 56 extend laterally through these ribs at the bottoms of grooves 52, with the holes in each groove 52 being aligned with each other and with similar holes 58 formed in the platform shell flanges 28, 32, 34 and 36.

The lower ends of hangers 14 extend into openings 20 in platform 12 and are pivotally secured to the platform by rods 62. The rods seat in grooves 52 and pass through holes 56 and 58 and through lateral passages 64 formed at the lower ends of hangers 14 so that the rods are parallel to the pivot pins 19 at the upper ends of hangers 14.

As best seen in FIG. 3, in the illustrated swing, the lower end of each hanger is flattened at 14*b* and wrapped around a short tube 66 engaged on a rod 62 between platform ribs 54. Preferably, for safety reasons, the flattened hanger end 14*b* that is turned back on itself is secured by fasteners 68 to the hanger proper. A pair of mirror image plastic shells 72*a* and 72*b* form a "doughnut" around each hinge connection of a hanger 14 to its rod 62, filling the corresponding opening 20 in platform 12 and moving with its hanger 14 to eliminate pinch points at each hinge location. In order to prevent lengthwise movements of rods 62, pairs of conventional locking caps 76 are press-fit onto the opposite exposed ends of those rods adjacent ribs 54. Preferably, the rod ends and end cap are recessed into the sides of platform 12 so that they cannot hurt the rider.

As shown in FIGS. 1 and 2, the distances between the pivot pins 19 which connect the upper ends of the hangers to bracket 16 and the bend angle of hanger segments 14*a* are selected with relation to the distance between the pivot rods 62 in platform 12 such that when the swing is at rest, the hangers are vertical.

Also, the distance between the pivot pins 19 is appreciably less than the distance between, rods 62. For example, in a swing whose hangers are 62 to 73 inches long measured in a straight line from end to end, the former may be 4 to 10 inches, the latter 18 to 24 inches. Actually, in the illustrated swing embodiment, these distances are 6 and 21.5 inches, respectively. This difference causes the platform 12 to follow a swing path which maintains the platform fairly level over a relatively large swing angle. In other words, the pitch of the moving platform is fairly small, indeed much smaller than that of conventional swing seat.

The surfer swing 10 shown in FIG. 1 pendulates back and forth in such a manner that the two hangers 14 are in a front-to-rear relationship in reference to a rider standing on platform 12. This encourages the rider to stand on the platform 12 more or less sideways as one would stand on a surfboard, with one hand holding the hanger in front and the other hand holding the hanger in back, and to initiate and maintain swinging movement by shifting his or her weight.

As the platform pendulates, the rate of change of the platform pitch relative to the horizontal ground plane is quite gradual as compared to a conventional swing seat which can tilt or pitch quite abruptly about its pivotal connections to the hangers. The resulting forward motion of the platform thus resembles the surging planing motion of a surfboard being thrust forward by a rising wave.

Since it is an object of the present invention to provide a swing that simulates a surfboard ride, it may be desirable to permit the platform to roll to a certain degree about the longitudinal axis of the seat during the ride.

The foregoing description has been limited to a specific embodiment of this invention. It will be apparent, however, that variations and modifications may be made to the invention, with the attainment of some or all of the advantages of the invention.

For example, the platform 12 may have a solid rather than a hollow body, as long as openings 20 are provided so that the hangers 14 can be pivotally connected to it. In this context, note that each hanger 14 can be pivoted to the platform 12 by mounting the pivot rods 62 to the flanges 34 and 36 around openings 20, instead of having the rods extend all the way across the platform 12.

Therefore, it is the object of the appended claims to cover all such variations and modifications as come within the true spirit and scope of the invention.

I claim:

1. A swing comprising an overhead support;

an elongated rigid platform having a longitudinal axis, opposite sides and opposite ends;

a pair of mirror-image hangers having upper and lower ends;

first and second spaced-apart pivot means, each having a pivot axis, pivotally connecting the lower ends of the hangers to the platform adjacent to the opposite ends thereof and on said platform axis, and third and fourth spaced-apart pivot means, each having a pivot axis pivotally connecting the upper ends of said hangers to the overhead support, the pivot axes of all of said pivot means being parallel to each other and perpendicular to said platform axis and the spacing of said third and fourth pivot means being less than that of the first and second pivot means, said hangers being shaped with relation to the pivot means spacings so that the hangers have lower parallel segments which are at least three times as long as the spacings of the first and second pivot means and relatively short in-turned upper segments which extend toward the third and fourth pivot means.

2. The swing defined in claim 1 wherein the platform has an elongated oval shape.

3. The swing defined in claim 1 wherein the spacing between the first and second pivot means is in the range of 18 to 24 inches and the spacing between the third and fourth pivot means is in the range of 4 to 10 inches.

4. The swing defined in claim 1 wherein the first and second pivot means each include means defining a transverse passage adjacent to the lower end of a hanger;

a rigid rod extending through the hanger passage transverse to said platform axis, and means for securing the rod to the platform.

5. A swing comprising an overhead support;

an elongated rigid platform having a longitudinal axis, opposite sides and opposite ends;

a pair of mirror-image hangers having upper and lower ends;

first and second spaced-apart pivot means each having a pivot axis and pivotally connecting the lower ends of the hangers to the platform adjacent to the opposite ends thereof and on said platform axis, said first and second pivot means each including means defining a transverse passage adjacent to the lower end of a hanger, a rigid rod extending through the hanger passage transverse to said platform axis, each rod having opposite ends projecting from the sides of the platform, and means for securing the rod to the platform, said securing means including retainer means affixed to the projecting ends of the rod to prevent appreciable longitudinal movement thereof;

third and fourth spaced-apart pivot means each having a pivot axis pivotally connecting the upper ends of said hangers to the overhead support, the pivot axes of all of said pivot means being parallel to each other and perpendicular to said platform axis and the spacing of said third and fourth pivot means being less than that of the first and second pivot means, and means defining vertical clearance openings in the platform at each pivotal connection thereto for accommodating the swinging movements of said hangers when the platform is in motion.

6. The swing defined in claim 5 and further including recesses in the sides of the platform adjacent to the projecting ends of the rods so that the retainer means are recessed into the sides of the platform.

7. The swing defined in claim 5 wherein the platform openings are elongated in the direction of said platform axis.

8. The swing defined in claim 5 and further including reinforcing flanges formed in said platform around said clearance openings.

9. The swing defined in claim 5 and further including guard means engaged to said rods and substantially filling said platform clearance openings.

10. A gym set including the swing defined in claim 5.

* * * * *